US010131845B2

(12) United States Patent
Qiu

(10) Patent No.: US 10,131,845 B2
(45) Date of Patent: Nov. 20, 2018

(54) AUTOMATIC CARBONIZING COLLECTOR FOR WASTES

(71) Applicant: Zeguo Qiu, Shenzhen (CN)

(72) Inventor: Zeguo Qiu, Shenzhen (CN)

( * ) Notice: Subject to any disclaimer, the term of this patent is extended or adjusted under 35 U.S.C. 154(b) by 330 days.

(21) Appl. No.: 14/725,008

(22) Filed: May 29, 2015

(65) Prior Publication Data

US 2016/0348007 A1 Dec. 1, 2016

(51) Int. Cl.
*C10B 19/00* (2006.01)
*C10B 53/00* (2006.01)

(52) U.S. Cl.
CPC ..... *C10B 19/00* (2013.01); *C10B 53/00* (2013.01)

(58) Field of Classification Search
CPC ..... C10B 19/00; C10B 53/00
USPC ..... 422/186, 186.04; 588/301, 311, 310; 201/35
See application file for complete search history.

(56) References Cited

U.S. PATENT DOCUMENTS 5,960,026 A * 9/1999 Nolting ..... C03B 3/02 219/121.48
6,152,050 A * 11/2000 Tsantrizos ..... C03B 5/005 110/185
7,025,006 B2 * 4/2006 Jeulin ..... B01D 53/02 110/229
9,121,605 B2 * 9/2015 Carabin ..... B09B 3/0025
2009/0121798 A1 * 5/2009 Levinson ..... H05B 6/802 331/71
2011/0311423 A1 * 12/2011 Clarke ..... B01D 53/864 423/235
2014/0090297 A1 * 4/2014 Juvan ..... C10J 3/32 48/66

FOREIGN PATENT DOCUMENTS

CN 203530160 * 4/2014 ..... C05F 9/02

OTHER PUBLICATIONS

Machine Translation CN 203530160 published Apr. 9, 2014.*
Machine Translatio CN 102583313 published Jul. 18, 2012.*
Advanced Claim Drafting Educational Material.*

* cited by examiner

*Primary Examiner* — Nina Bhat

(57) ABSTRACT

A method of using automatic carbonizing collector to eliminate waste on site pertains to automatic collection of wastes, reduce, recycle and eliminate the wastes on the site where the waste producing, to replace manual door to door collection, landfill and incineration of wastes. The carbonizing collectors set in where the waste producing is comprised of an automatically opening lid (4), putting wastes into container (2) set in carbonizing tank (14), carbonizing the wastes under anaerobic condition by heater (13) and burner (16), collecting carbonized products by pipe (15) and pipeline (202) which connecting with all of the carbonizing collectors in a city, storing the products in tank (18) and collecting tank (207) of the carbonizing collectors for fuel, cleaning the carbonized products in carbonizing tank (14) by taking out pail (3), shredding the carbonized products into conductible particle, the carbonized products going through pipeline (202) to collecting tank (207). A supervisory control center (205) and a main board (21) set in the carbonizing collector automatically manage the project formed by the pipeline (202) and the carbonizing collectors.

6 Claims, 2 Drawing Sheets

AUTOMATIC CARBONIZING COLLECTOR FOR WASTES

BACKGROUND

Field of the Invention

The present invention, a method of using automatic carbonizing collector to eliminate the wastes on site, pertains, in general, to automatically collecting, automatically decomposition of wastes, and to automatically reducing, reusing, disinfecting and eliminating the wastes on site, and in where the waste producing.

Background Art

Solid waste is a huge challenge for the dwellers, municipalities, industries, and businesses. It is expensive and time consuming to collect millions of tons of trash every year, and there are risks to the environment.

Current process and management for the solid wastes in the world are that putting the solid wastes into specified containers, packaging by the plastic package, manual door to door collecting, and transporting to the specified disposal site. It is time consuming, energy wasting, inconvenience and high cost. Besides, it caused the wastes breeding ground for insects, vermin, and scavenging animals, and can to pass on air- and water-borne diseases. It is infecting source, risk to the health of citizens. It causes putrescent, eye-scores and odor that vexes citizens. Disposal such wastes are landfill and incinerating. However, landfill and incinerating are pollutant transfer, which cause serious secondary pollution. In the modern city, the population increasing and economic development lead to the municipal waste increasing dramatically. The urban expending causes the shortage of the landfill site. The incinerating causes serious air pollution that threatens the health of the population and exacerbates the air pollution. The municipalities face the big challenge of the solid waste. The city's waste prevention and recycling programs have evolved dramatically from their inception in the 1980s. Recycling has its origins in fledgling voluntary programs. It depends the manual identification and voluntary sort which are impacted by human's consciousness, behaviors and knowledge. The efficiency is less. Over the years, the municipalities and governments cost high to have established an array of programs to promote reduction, reuse and recycling of wastes generated by residents, businesses, government agencies, schools and institutions. No matter how strive they did, the solid waste impact is increased, the reduce, reuse and recycle rate are declined. Identifying and sorting the wastes by manual can cause faults easily, any fault can cause the fail of the waste sort, besides the wastes collected have to transport to specified site to landfill and incinerate, and that increases the cost for the waste. Designing a method to reduce, disinfect and eliminate the wastes on the site where the waste producing is the main target of the invention.

Currently, there are less research, patent and essay involved in the waste reduce, recycle and disinfect in where the waste producing. Bio composting in resident unit, such as green bin, needs long time ferment and extra space to deposit of the waste. It can cause odor, breeding for insects and pollution. That is difficult to practice for residents.

The invention hereby is to build an effective, quiet and safe method and apparatus to deal with such problem, to overcome the waste pollution and achieve all kinds of the wastes automatically receiving, collecting, depositing, recycling, reducing, disinfecting, and eliminating the wastes on site and in where the waste producing without any pollution, to reach at automatic collection of the municipal waste in a city to replace the manual door to door collection of the waste.

SUMMARY

The present invention, a method of using automatic carbonizing collector to eliminate the wastes on site, is designed to receive, collect, deposit, reduce, recycle, disinfect and eliminate all of the wastes on site and where the waste producing, to replace manual door to door collection of the wastes, and reach at waste management automation is comprised of:

setting automatic carbonizing collectors in the location where the wastes producing, such as kitchen, clinic and business units;

when user going near the automatic carbonizing collector, lid (4) is automatically opened by automatic lid infrared sensor opener assembly (7);

putting all of wastes into container (2) set in carbonizing tank (14) of the automatic carbonizing collectors;

automatically closing the lid (4) when user getting off the automatic carbonizing collector;

depositing the wastes in the container (2);

disinfecting the wastes in the container (2) and eliminating odor by ultraviolet and ozone producing assembly (6) instantly;

setting working time and selecting mode by control panel (8);

according to the designed program set in main board (21);

automatically starting the automatic carbonizing collector and tightening the seal ring (5);

heating up carbonizing tank (14) of the automatic carbonizing collector by turning on microwave and electrical heater assembly (13);

driving air out of the carbonizing tank (14) and vacuuming carbonizing tank (14) by compressor (11) to ensure the carbonizing tank (14) in anaerobic condition for carbonization and prevent toxic gas, such as dioxin;

turning on automatic burner (16) by automatic igniting and safe protecting assembly (17), increasing the combusting efficiency and purifying exhaust gas by conducting exhaust gas passing through heat collector (12), exhaust fan purifier and exhaust pipe assembly (10), and then to outdoor to prevent monoxide, dioxide and gas indoor transnormal;

drying the waste in carbonizing tank (14) in a vacuum and hot sphere;

disinfecting and purifying exhaust gas and eliminating pollutants producing in carbonizing tank (14) by conducting the exhaust gas going through purifying assembly (19), automatic burner (16), and exhaust fan purifier and exhaust pipe assembly (10) to outdoor;

carbonizing the wastes in carbonizing tank (14) by heating up the tank (14) with microwave and electrical heater assembly (13), and automatic burner (16);

collecting fuel gas and liquid producing from carbonization by conducting the fuel gas and liquid through collecting pipe (20), purifying the fuel gas and liquid by purifying assembly (19), compressing the fuel gas and liquid by compressor (11), and depositing the fuel gas and liquid in fuel gas and liquid tank (18) for the energy source of the automatic carbonizing collector, that forms a energy self supply system;

vacuuming carbonizing tank (14) by compressor (11) to prevent residual gas, liquid and odor pollution;

after cooling, collecting the carbonized products, such as carbon produced by waste carbonization in carbonizing tank (14) by automatically open the lid (4), and taking out pail (3) and clean the carbonized products out;

getting at automatic collection of the waste in a city by setting up pipeline (202) which connects all of the automatic carbonizing collectors in a city, fluidizing the carbonized products, the carbon, and the fuel gas, fuel liquid in carbonizing tank (14) into conductible particle by a shred and fluidizing assembly set in the carbonizing tank (14) and driving the fluidized carbonized products by pumps (208), transporting the fluidized carbonized products, the carbon, the fuel gas and liquid in the carbonizing tank (14) going through the pipeline (202) to specified collecting tank (207), and automatically managing the waste pipeline collecting system and automatic carbonizing collectors by supervisory control center and center computer (205) through remote information exchange system (206).

That reaches at the aim of automatically receiving, collecting, depositing, recycling, reducing, disinfecting and eliminating all of the wastes on site and in where the waste producing without of pollution and safe for user, self recycling and reusing the waste and reaches at automatically collection of the municipal waste in a city, and waste management automation to replace the manual door to door collection, landfill and incineration of wastes.

DETAIL DESCRIPTION

Figure 1:
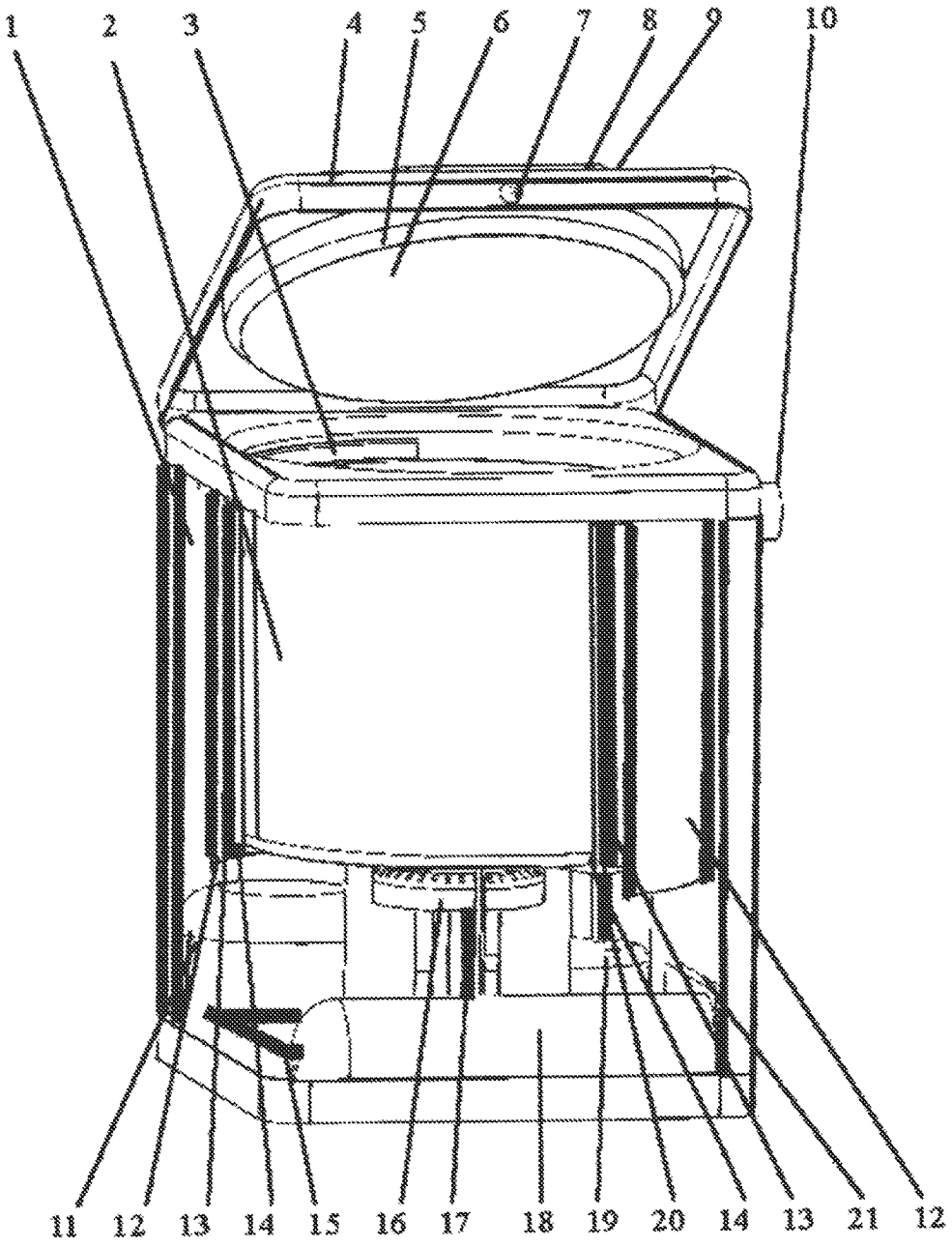
FIG. 1 is a section view of automatic carbonizing collector for wastes.

With reference to accompanying drawings, the present invention, a method of using automatic carbonizing collector to eliminate the wastes on site is explained in details. Waste heated in anaerobic condition can be carbonized and produce fuel gas and liquid. To reach at automatically receiving, collecting, depositing, recycling, reducing, disinfecting and eliminating all of the wastes on site and in where the waste producing, clean and safe for user, quite and high efficient, the invention designed a method which is comprised of:

setting the automatic carbonizing collector in the location where the waste producing, carbonizing the waste on site and in where the waste producing can largely reduce the waste, the frequency of collecting and the cost of the waste collection and transportation;

setting automatic lid infrared sensor opener assembly (7) in the automatic carbonizing collector is easy for user;

setting container (2) in the carbonizing tank (14) of the automatic carbonizing collector is to receive and deposit wastes, and easy cleaning the carbonized products out of the carbonizing tank (14);

when user getting off the automatic carbonizing collector, the lid (4) automatically closed immediately that is to prevent odor and animals touch it;

instantly disinfecting the wastes in the container (2) and eliminating odor by ultraviolet and ozone producing assembly (6) can prevent the odor, pollution and hazard of the waste instantly, especially the medical waste, it can prevent the virus and bacteria get out of the collector by opening the lid (4) and safe user;

depositing the wastes in the container (2), the wastes put in the automatic carbonizing collector can deposit in the container (2) after disinfecting instantly;

setting working time and mode by control panel (8), by which set up the man-machine communication system, it makes the automatic carbonizing collector manageable;

according to the designed program set in main board (21), the main board (21) is automatic management center of the automatic carbonizing collector, by the maim board (21), all data can input and output and deposit in it, it manages each parts of the automatic carbonizing collector working according the program set logically;

automatically starting and tightening the seal ring (5) at a set time and cut off the air that makes the carbonizing tank (14) in anaerobic condition;

turning on microwave and electrical heater assembly (13) and heat up carbonizing tank (14), microwave and electrical heater assembly (13) is one of the heat source of the automatic carbonizing collector, microwave heater assembly (13) is employed to increase equability and efficiency to carbonizing and disinfecting the wastes in the container (4), it is the important heat source, when at the first time starting of the automatic carbonizing collector;

driving air out of carbonizing tank (14) and vacuuming carbonizing tank (14) by compressor (11) to ensure there is no oxygen in carbonizing tank (14) and prevent produce odor and toxic gas, such as dioxin, setting carbonizing tank (14) is to ensure carbonizing the waste in a safe pressure, temperature and anaerobic condition, and hold the reaction and its products in the tank;

turning on automatic burner (16) by automatic igniting and safe protecting assembly (17), driving and purifying the exhaust gas by exhaust fan purifier and exhaust pipe assembly (10), conducting exhaust gas passing through heat collector (12) to increase the efficiency and the purification, and then to outdoor to prevent monoxide, dioxide and gas indoor transnormal;

drying the waste in carbonizing tank (14) by vacuum and heat;

disinfecting and purifying exhaust gas and pollutants producing in carbonizing tank (14) by conducting the exhaust gas pass through purifying assembly (19), automatic burner (16), and exhaust fan purifier and exhaust pipe assembly (10);

carbonizing the waste in carbonizing tank (14) through heating up by microwave and electrical heater (13) and automatic burner (16);

collecting fuel gas and liquid producing from carbonization, building up the heat self supply system for the automatic carbonizing collector, conducting the fuel gas and liquid by collecting pipe (20), purifying the fuel gas and liquid by the purifying assembly (19), compressing the fuel gas and liquid by compressor (11), and depositing the fuel gas and liquid in fuel gas and liquid tank (18) for next recycle, that forms a heat self supply system;

vacuuming carbonizing tank (14) by compressor (11) to prevent residual gas, liquid and odor pollution;

after cooling, collecting the residual waste, carbon produced by waste carbonization in carbonizing tank (14) by automatically open the lid (4), and taking out pail (3) and clean it out.

Reaching at the municipal waste automatically collection by setting up waste pipeline automatically collecting system. The carbonized products, such as the fuel gas and liquid, and the carbon, produced by waste carbonization in carbonizing tank (14) can reach at automatic collection by connected pipeline, and automatically transport to specified site, in the residence, each automatic carbonizing collector can be connected by pipeline, fluidizing the carbonized products in carbonizing tank (14) into conductible particle by a shred and fluidizing assembly set in the carbonizing tank (14), and driving it by pump and suction, transporting all of the carbonized products, the fuel gas and liquid, and the residual waste, the carbon produced by the waste carbonization in carbonizing tank (14) going through the connected pipeline to specified plants, the automatically managing the waste pipeline collecting system by center computers through remote information exchange system set between the center computer and terminal units, the automatic carbonizing collectors, that reach at the municipal waste in a city automatic collection and automatic management, by further separating and purifying in the plant, get the recycle products, the fuel gas and liquid, and the carbon, the municipal wastes recycle on the site where the waste producing, the recycle products automatically collected by pipeline, the municipal waste management in a city reaches at automation and replace the current manual door to door collection of the wastes, and it will largely reduce the cost of the waste collection and disposal, save the land from landfill and prevent the pollution from the waste incinerating.

Automatically controlling the pressure and temperature of carbonizing waste process by automatic pressure temperature controlling assembly set in the carbonizing tank (14), it is to ensure the efficiency of carbonization and safety, any fault, transnormal and trouble caused can be automatically inform to center computer through the remote information exchange system, and instruct a trouble shooting system correcting it in advance to prevent accident.

There are many working mode programmed in the main board (21) for selecting to deal with different wastes coming from different source, such as for plastic waste, the temperature of the carbonizing tank (14) is set between 90-110 centigrade, after disinfecting and making the waste soft, shred the waste into flowable particle and collecting it for reuse; if for food waste, the temperature of the carbonizing tank (14) is set between 100-110 centigrade, drying the food waste, after disinfecting, and shredding the food waste into flowable particle, and collecting it for protein recycle; if it is for medical waste, the temperature of the carbonizing tank (14) is set between 300-350 centigrade, after completely carbonization, shredding the carbon into flowable particle, and collecting the gas, liquid, and carbon for fuel.

Preventing hazard by setting the automatic monoxide, dioxide and gas alarm assembly (9) in the automatic carbonizing collector, any transnormal of monoxide, dioxide, gas and odor in the room, the monoxide, dioxide and gas alarm assembly (9) can automatically be acted by the sensors, alarming, informing the center computer, array the transnormal information logically on display, acting the exhaust fan purifier and exhaust pipe assembly (10), driving the hazard gas and pollutants out of the room.

A supervisory control center is employed to automatically manage and monitor the automatic carbonizing collectors set in a regional area, the automatic waste transporting pipeline. It is comprised of center computer and controlling system, the human machine interface which set to input the program and instruction in the computer to automatically manage and control the automatic carbonizing collectors and pipeline, collecting data, recording, organizing, editing and compiling the instruction and the data.

Heater in the waste carbonizing process is comprised of electronic arc heater, plasma heater, microwave heater, and burning heater. It depend the requirement of different wastes coming from different producing source, recycle, reuse and in different working condition.

Advantage

The present invention, a method of using automatic carbonizing collector to eliminate the wastes on site focuses automatically receive, collect, deposit, recycle, reuse and eliminate the waste on site and in where the waste producing. It disinfects and carbonizes the waste on site and in where the waste producing, that largely reduces the volume of the waste, the weight of the waste and the hazard of the waste. Collecting the carbonized and disinfected products by automatic pipeline and replacing the manual door to door collection of the waste, that largely reduces the cost of waste collection and the cost of waste disposal. Disinfecting and carbonizing the waste on site and in where the waste producing, eliminating the hazard of the waste on site and in where the waste producing, it is clean for user, there is no spread for disease. Carbonizing the waste on site and in where the waste producing is easy user without the intricate waste sorting process that saves time and manpower, reduces the liability of the household. The present invention uses the products, the fuel gas and liquid producing from the carbonization of waste as heat source for automatic carbonizing collector, it saves energy and power. The last but not least is that eliminates the pollution from landfill and incinerating, saves land and resource.

Illustrate by Figures and Example

FIG. 1 is a section view of automatic carbonizing collector, in the figure, the automatic carbonizing collector is comprised of holder (1), container (2), pail (3), lid (4), seal ring (5), ultraviolet and ozone producing assembly (6), automatic lid infrared sensor opener assembly (7), control panel (8), carbon monoxide carbon dioxide and gas automatic sensor alarm assembly (9), exhaust fan purifier and exhaust pipe assembly (10), compressor (11), heat collector (12), microwave and electrical heater assembly (13), carbonizing tank (14), gas and fuel pipe (15), automatic burner (16), automatic igniting and safe protecting assembly (17), fuel gas and liquid tank (18), purifying assembly (19), fuel gas and liquid collecting pipe (20), main board (21).

Figure 2:
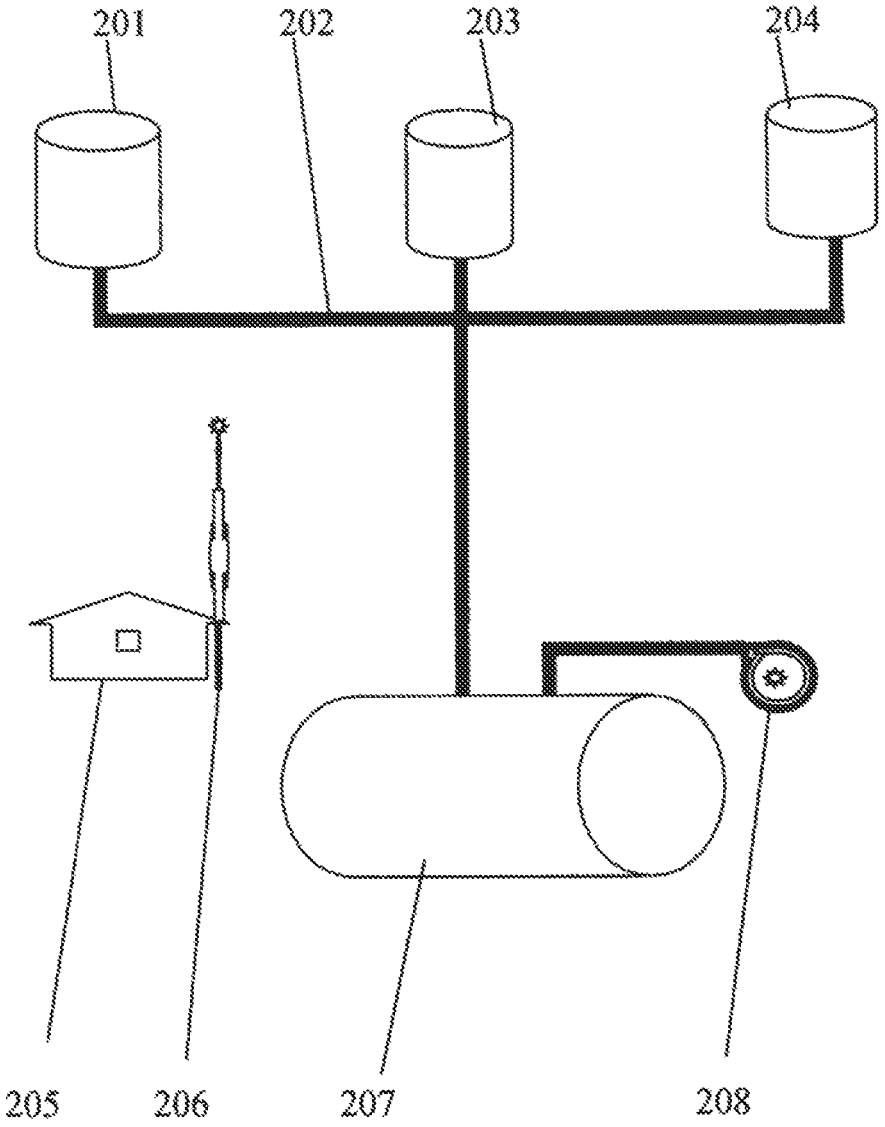
FIG. 2 is a view of automatic collecting system for carbonized products.

FIG. 2 is a view of automatic collecting system for carbonized products, in the figure, the automatic collecting system is comprised of automatic carbonizing collector (201) set in kitchens, automatic carbonizing collector (203) set in business units, automatic carbonizing collector (204) set in public squares, all of the automatic carbonizing collectors are connected by pipeline (202) with center collecting tank (207) and a vacuum pumper (208), a supervisory control center and computer (205) automatically manages the system through a remote information exchanging system (206).

Example 1, Industrial Application

A project for industrial application is comprised of:

setting the automatic carbonizing collectors in kitchens of residence, business units, and public squares;

connecting the automatic carbonizing collectors with center tank (207) and vacuum pumper (208) by pipeline (202), and forming an automatic collecting system for carbonized products from wastes;

automatically managing the collecting system by a supervisory control center through remote information exchanging system (206);

automatically opening lid (4) of the automatic carbonizing collector by lid infrared sensor opener assembly (7) when user going near the collector to drop waste;

dropping wastes into container (2) of the automatic carbonizing collector, automatically closing the lid (4) and depositing the wastes in the container;

disinfecting the wastes in the container (2) instantly by ultraviolet and ozone producing assembly (6) to prevent odor, pollution and hazard from the wastes;

starting the automatic carbonizing collectors according to the instruction of the supervisory control center;

automatically tightening the seal ring (5) and cut off the air, making the carbonizing tank (14) in anaerobic condition;

heating up carbonizing tank (14) by microwave and electrical heater assembly (13) and automatic burner (16);

drying the waste in carbonizing tank (14) and pumping the exhaust gas out of the tank (14) by compressor (11);

disinfecting and purifying the exhaust gas producing in carbonizing tank (14) by purifying assembly (19), automatic burner (16), and exhaust fan purifier and exhaust pipe assembly (10);

carbonizing the waste in carbonizing tank (14) according the program set in main board (21);

after cooling, shredding the carbonized products in carbonizing tank (14) into flowable particle by fluidizing assembly;

starting vacuum pumper (208) according the instruction of supervisory control center (205), driving the carbonized products, the fuel gas and liquid, and carbon in carbonizing tank (14) going through pipeline (202) into center collecting tank (207);

vacuuming carbonizing tank (14) by vacuum pumper (206) to prevent odor and pollution;

after separating and purifying, get the fuel gas and liquid, and carbon;

the data automatically collected by supervisory control center (205) through the remote information exchange system (206), and arraying on the display logically;

automatically monitoring the temperature, pressure, and pollutant, such as the gas, monoxide, dioxide and odor by supervisory control center (205) through the remote information exchange system (206) to ensure the safety for users.

Example 2, Medical Waste Application

Medical waste is a source of infecting disease and risk to environment. Most of the clinics located in the residence with high density of population. It threatens the health of population. Automatic carbonizing collector gives a safe solution to the medical waste. An application example for medical waste is comprised of:

setting automatic carbonizing collector in where the medical waste producing, such as surgery, sickroom and inject room;

automatically opening lid (4) of automatic carbonizing collector by lid infrared sensor opener assembly (7);

putting wastes into container (2) of the automatic carbonizing collector and depositing the wastes in the container (2);

automatically closing the lid (4) to prevent odor, leak and animals touch it;

disinfecting the wastes in the container (2) instantly and eliminating odor by ultraviolet and ozone producing assembly (6);

setting working time and selecting work mode by control panel (8);

automatically starting up the automatic carbonizing collector and tightening seal ring (5) at a set time and keeping carbonizing tank (14) in anaerobic condition;

heating the wastes in carbonizing tank (14) by microwave and electrical heater assembly (13) and automatic burner (16);

drying the wastes in carbonizing tank (14) by vacuum and heat;

disinfecting and purifying exhaust gas producing in carbonizing tank (14) by purifying assembly (19), the high temperature of automatic burner (16), and exhaust fan purifier and exhaust pipe assembly (10) and conducting the exhaust gas pass through exhaust pipe assembly (10) to outdoor;

carbonizing the waste in carbonizing tank (14) by microwave and electrical heater (13) and automatic burner (16);

collecting fuel gas and liquid producing from carbonization by conducting the fuel gas and liquid through collecting pipe (20), purifying the fuel gas and liquid by the purifying assembly (19), compressing the fuel gas and liquid by compressor (11), and depositing the fuel gas and liquid in fuel gas and liquid tank (18) and forming a heat self supply and reuse system;

vacuuming carbonizing tank (14) by compressor (11) to prevent residual gas, liquid and odor pollution;

after cooling, collecting the carbon produced by waste carbonization in carbonizing tank (14) by automatically open the lid (4), and taking out pail (3) and clean it out;

preventing hazard by automatic monoxide, dioxide and gas alarm assembly (9);

decomposing and disinfecting the medical waste on the site where the waste producing by the automatic carbonizing collector, it eliminates the infecting source of disease and ensures the safety for citizen.

What is claimed is:

1. A method of using automatic carbonizing collector to eliminate waste on site is designed to automatically receive, collect, deposit, reduce, recycle, disinfect and eliminate all of the wastes on site and in where the wastes producing, to replace manual door to door collection of the wastes, and reach at waste management automation is comprised of:

setting automatic carbonizing collectors in the location where the waste producing, including kitchen, clinic and business units;

automatically opening lid (4) of the automatic carbonizing collectors by automatic lid infrared sensor opener assembly (7);

putting all of wastes into container (2) set in carbonizing tank (14) of the automatic carbonizing collectors;

automatically closing the lid (4) of the automatic carbonizing collector and depositing the wastes in the container (2) of the automatic carbonizing collectors;

disinfecting the wastes in the container (2) and eliminating odor by ultraviolet and ozone producing assembly (6) instantly;

setting working time and selecting mode by control panel (8);

automatically starting the automatic carbonizing collector and tightening the seal ring (5) according to the designed program set in main board (21);

heating up carbonizing tank (14) of the automatic carbonizing collector by microwave and electrical heater assembly (13) and automatic burner (16) which ignited by automatic igniting and safe protecting assembly (17);

driving air out of carbonizing tank (14) and vacuuming carbonizing tank (14) by compressor (11) to ensure the carbonizing tank (14) in anaerobic condition;

drying the wastes in carbonizing tank (14) in a vacuum and hot sphere;

disinfecting and purifying exhaust gas and eliminating pollutants producing in carbonizing tank (14) by purifying assembly (19), automatic burner (16), and exhaust fan purifier and exhaust pipe assembly (10), and driving the exhaust gas going to outdoor by exhaust fan purifier and exhaust pipe assembly (10);

increasing the combust efficiency and purifying the exhaust gas by conducting the exhaust gas going through heat collector (12), exhaust fan purifier and exhaust pipe assembly (10), and then going to outdoor to prevent monoxide, dioxide and gas indoor transnormal;

carbonizing the wastes in carbonizing tank (14) by microwave and electrical heater assembly (13), and automatic burner (16);

collecting carbonized products, fuel gas and liquid producing from carbonization through collecting pipe (20), and purifying the fuel gas and liquid by purifying assembly (19), compressing the fuel gas and liquid by compressor (11), and depositing the fuel gas and liquid in fuel gas and liquid tank (18) for fuel source of the automatic carbonizing collector, that forms a energy self supply system;

vacuuming carbonizing tank (14) by compressor (11) to prevent residual gas, liquid and odor pollution;

after cooling, collecting the carbonized products, carbon produced by waste carbonization in carbonizing tank (14) by automatically open the lid (4), and taking a pail (3) out, and clean it;

getting at automatic collection of the waste in a city by setting up pipeline (202) which connects all of the automatic carbonizing collectors in a city, fluidizing the carbonized products, the carbon, and the fuel gas, fuel liquid in carbonizing tank (14) into conductible particle by a shred and fluidizing assembly set in the carbonizing tank (14) and driving the fluidized carbonized products by pumps (208), transporting the fluidized carbonize products, the carbon, the fuel gas and liquid in the carbonizing tank (14) going through the pipeline (202) to specified collecting tank (207), and automatically managing the waste pipeline collecting system and automatic carbonizing collectors by supervisory control center and center computer (205) through remote information exchange system (206).

2. The method of using automatic carbonizing collector to eliminate the waste on site of claim 1 wherein the pressure and temperature of carbonizing tank (14) is automatically controlled by automatic pressure temperature controlling assembly set in the carbonizing tank (14) to ensure the efficiency of carbonization and safety, any fault, transnormal and trouble caused can be automatically monitored and informing to supervisory controlling center and center computer (205) through remote information exchange system (206), and instructing a trouble shooting system correcting it in advance to prevent accident.

3. The method of using automatic carbonizing collector for waste to eliminate the waste on site of claim 1 wherein there are working modes set in main board (21) for selecting to disposal of the different wastes coming from different producing source.

4. The method of using automatic carbonizing collector to eliminate the waste on site of claim 1 wherein preventing hazard by setting automatic monoxide, dioxide and gas alarm assembly (9) in the automatic carbonizing collector, any transnormal of monoxide, dioxide, gas, odor and pollutants in room, the monoxide, dioxide and gas alarm assembly (9) can automatically be acted by sensors, and alarming, informing the center computer (205) through remote information exchange system (206), arraying the transnormal information logically on display, acting the exhaust fan purifier and exhaust pipe assembly (10), purifying the pollutants and driving the hazard gas out of the room.

5. The method of using automatic carbonizing collector to eliminate the waste on site of claim 1 wherein the supervisory control center is comprised of center computer which is set to input the program and instruction into the computer to automatically manage and control the automatic carbonizing collectors and pipeline, collecting data, recording, organizing, editing and compiling the instruction and the data.

6. The method of using automatic carbonizing collector to eliminate the waste on site of claim 1 wherein the heater in the waste carbonizing process of the automatic carbonizing collector is comprised of electronic arc heater, plasma heater, microwave heater, and burning heater, each of them can be selected, simplified and reformed for specified use.

* * * * *